United States Patent [19]

Gentile

[11] 4,449,658

[45] May 22, 1984

[54] ADJUSTABLE INPUT SHAFT FOR PRESS FEED

[75] Inventor: Joseph P. Gentile, Pittsburgh, Pa.

[73] Assignee: Vamco Machine & Tool, Inc., Pittsburgh, Pa.

[21] Appl. No.: 444,604

[22] Filed: Nov. 26, 1982

[51] Int. Cl.[3] ..... B65H 17/26

[52] U.S. Cl. ..... 226/138; 403/373

[58] Field of Search ..... 226/120, 137, 139, 147–149, 226/152, 154, 155, 142; 403/109, 356, 373, 377; 83/236, 202, 282

[56] References Cited

U.S. PATENT DOCUMENTS

| | | | |
|---|---|---|---|
| 836,706 | 11/1906 | Richards | 403/373 |
| 3,638,846 | 2/1972 | Wiig | 226/142 |
| 3,758,011 | 9/1973 | Portmann | 226/142 |
| 3,784,075 | 1/1974 | Portmann | 226/142 |
| 4,138,913 | 2/1979 | Gentile | 83/236 |
| 4,156,387 | 5/1979 | Portmann | 100/257 |
| 4,304,348 | 12/1981 | Kato | 226/152 |
| 4,316,569 | 2/1982 | Gentile | 226/158 |

*Primary Examiner*—Leonard D. Christian

*Attorney, Agent, or Firm*—Stanley J. Price, Jr.; John M. Adams

[57] ABSTRACT

A two part input shaft is drivingly connected to a crankshaft of a punch press for rotation at a predetermined speed. An adjustable cam drive mechanism drivingly connects the input shaft to a driven feed roll. Continuous rotation of the input shaft is converted by the adjustable cam drive mechanism to intermittent rotation of the feed roll. The intermittent rotation of the feed roll is timed with the press operation so that the feed roll intermittently advances a preselected length of the workpiece to the press after each press operation. A clamp arrangement releasably engages a first portion of the input shaft to a second portion of the input shaft so that, upon disengagement of the clamp arrangement, relative rotation is permitted between the input shaft first and second portions. The input shaft first portion is drivingly connected to the crankshaft of the press and the shaft second portion is drivingly connected to the adjustable cam drive mechanism. When the input shaft first and second portions are drivingly connected, the continuous rotation of the crankshaft is transmitted to the adjustable cam drive mechanism. Releasing the clamp disengages the shaft first and second portions from one another to permit adjustments to be made in the timed relationship between the feeding of the workpiece to the press and the operation of the press on the workpiece.

10 Claims, 8 Drawing Figures

ADJUSTABLE INPUT SHAFT FOR PRESS FEED

BACKGROUND OF THE INVENTION

1. Field of the Invention

This invention relates to apparatus for intermittently feeding a workpiece to a press and more particularly to an arrangement for releasably connecting the drive connection between the press and the feeding apparatus to permit independent adjustments in the press and feed cycles and thereby maintain the press and feed cycles in the proper timed relation when the drive from the press is connected to the drive for the feed.

2. Description of the Prior Art

In automatic strip feeding operations, as disclosed in U.S. Pat. Nos. 3,638,846; 3,758,011; 3,784,075; 4,138,913 and 4,304,348, a continuous strip of material is fed from a coil to the dies of a press for punching, stamping, cutting or the like, of a preselected length of the material. The material must be fed from the coil in timed relation with the press operation so that when the dies contact the material, the material is released from the feed so that the feed is interrupted and the material is stationarily positioned between the dies. After the press operation is completed, the feed is actuated to advance another preselected length of the material to the press. Therefore, the feeding of the stock material to the press must be coordinated with each press operation so that prior to each operation a new segment of material is is position relative to the dies for the press operation.

U.S. Pat. No. 4,316,569 discloses an adjustable cam feed that includes an input shaft drivingly connected to a driven feed roll that is rotatably supported in a feed roll unit and is positioned in overlying relation with an idler feed roll, which is rotatably supported in the feed roll unit. The workpiece is caught between the feed rolls. The adjustable cam drive converts uniform, continuous rotation of an input shaft drivingly connected to a crankshaft of the press to non-continuous, intermittent rotation of the driven feed roll. Thus, the feed rolls intermittently advance preselected lengths of the workpiece to the press in timed relation with the press operation. Each time the press dies are actuated, another length of the workpiece is positioned between the dies.

With the above-described arrangement, a cam is nonrotatably connected to the input shaft. A cam follower rides on the cam surface of the cam and is nonrotatably connected to an output shaft associated with the driven feed roll. The cam continuously rotates with the input shaft driven by the press crankshaft and generates oscillating rotational movement of the cam follower through a preselected angular path. Upon one complete rotation of the cam, the cam follower is rotated in a first direction through an arc of a preselected angle and then is rotated in the opposite direction back through the same angle of rotation to the original starting position. At the end of each angle of rotation of the cam follower, the cam follower experiences a dwell. For example, after rotation in a first direction during the feeding of the workpiece to the press, a 30° dwell time follows and then the feed executes a roll return, followed by another 30° dwell period. During the dwell periods, there is no transmission of rotation from the cam to the cam follower. The dwell time is necessary for proper operation of the feed so that the sequence of events that takes place within the feed is in proper synchronization with the events taking place in the press. This is known as feed to press timing.

Feed to press timing heretobefore has been accomplished with substantial difficulty because the timing belt which connects the feed to the press had to be loosened and disengaged from the feed input shaft sprocket. With the press in proper position, such that the die sequence of events is correct, the timing belt is removed from engagement with the feed roll unit. The feed roll unit is then oriented to the proper position in the feed cycle in relation to the press cycle. This has been accomplished by rotating the input shaft into alignment with a preselected set of timing marks on the machine frame. At this location of alignment, the feed is positioned relative to the press to carry out the feeding operation and the press operation in the proper timed sequence. During the press operation, the workpiece is not being fed to the press. After the press operation and the release of the dies from the workpiece, a preselected length of the workpiece is fed to the press.

In connecting the timing belt from the press crankshaft to the feed input shaft, it is the common practice to tighten the belt on the feed input shaft with a belt tensioner. This is difficult without rotating the feed input sprocket, thereby displacing the input shaft from its required position relative to the press. If the timing belt is looped around the sprocket and engaged inadvertently when slack is withdrawn, the input sprocket will rotate. Extreme care must be exercised to engage the belt to the feed input sprocket in a manner such that when the slack is removed, the belt will become taut around the feed input sprocket without rotating the input sprocket and removing the input shaft from proper register with the position of the press.

The conventional timing belt includes sprockets having a pitch of either ½ or ⅞ inch. Consequently, the tooth engagement of the belt to the sprocket takes place only at increments of ½ or ⅞ inch. As a rule, seldom does the belt tooth properly engage the pulley tooth without requiring some degree of rotation of the feed input shaft. This has the disadvantage of removing the angular position of the feed input shaft from proper register with the press position.

Therefore, there is need in strip feeding apparatus to provide means for efficiently engaging and disengaging the drive connection of the strip feeding apparatus to a press without displacing the position of the feed input shaft from preselected register with the position of the press so that the required synchronization between the operation of the press and the operation of the feed is maintained.

SUMMARY OF THE INVENTION

In accordance with the present invention, there is provided apparatus for intermittently feeding a workpiece to a press that includes press drive means for generating continuous rotation at a predetermined speed. An input shaft is supported for rotation in a machine frame. The input shaft has a first portion and a second portion. Clamp means releasably engage the input shaft first portion to the input shaft second portion to permit relative rotation between the input shaft first and second portions. The press drive means is drivingly connected to the input shaft first portion to rotate the input shaft at the predetermined speed. Feed means supported in the frame intermittently feeds a preselected length of the workpiece to the press. Rotation transmission means supported in the machine frame drivingly connects the input shaft second portion to the feed means to convert the continuous rotation of the input shaft to intermittent rotation of the feed means and intermittently feed a preselected length of the workpiece to the press in timed relation with the press operation. The clamp means is releasable to drivingly disconnect the input shaft first portion from the input shaft second portion to permit relative rotation between the first and second portions and allow adjustments in the timed relation between the feeding of the workpiece to the press and the operation of the press on the workpiece.

In one embodiment of the present invention, the input shaft first portion has an end portion extending into a bore in the adjacent end portion of the shaft second portion. The shaft first portion is rotatable relative to the shaft second portion. The portion of the shaft second portion around the shaft first portion is split to permit radial expansion and contraction of the shaft second portion into and out of frictional engagement with the shaft first portion.

The clamp means surrounds the connection of the shaft first portion to the shaft second portion. The clamp when tightened urges the shaft second portion into frictional engagement with the shaft first portion. The shaft portions are thus connected to rotate as a single unit.

Loosening the clamp means releases the shaft second portion from the shaft first portion to permit relative rotation therebetween. The shaft portions are disconnected to facilitate synchronization of the workpiece feeding operation with the punch operation. Once the shaft first and second portions are positioned in the required register to obtain synchronization of the feeding and press operations, the clamp is tightened so that the shaft portions are connected to transmit rotation from the press to the feed to carry out the feed operation.

Accordingly, the principal object of the present invention is to provide, in strip feeding apparatus, an efficient arrangement for drivingly connecting and disconnecting the press to the feed apparatus in a manner to assure that once the feed apparatus is synchronized with the press, the feed apparatus can be drivingly engaged and disengaged with the press while maintaining the required synchronization between the feed and press operations.

Another object of the present invention is to provide a feed input shaft for connecting the crankshaft of a press to an intermittently driven feed roll in which portions of the feed input shaft are connected to the press crankshaft and feed roll drive, permitting efficient adjustments in synchronizing the operation of the press with the feed so that the press cycle and the feed cycle are performed in timed sequence.

A further object of the present invention is to provide a feed input shaft having a two part construction permitting relative movement of one part to another so that continuous drive from a press can be transmitted to an intermittent feed device and adjustments in the timed relationship of the press operation and the feed operation can be easily performed and maintained.

These and other objects of the present invention will be more completely disclosed and described in the following specification, the accompanying drawings and the appended claims.

DESCRIPTION OF THE PREFERRED EMBODIMENTS

Figure 2:
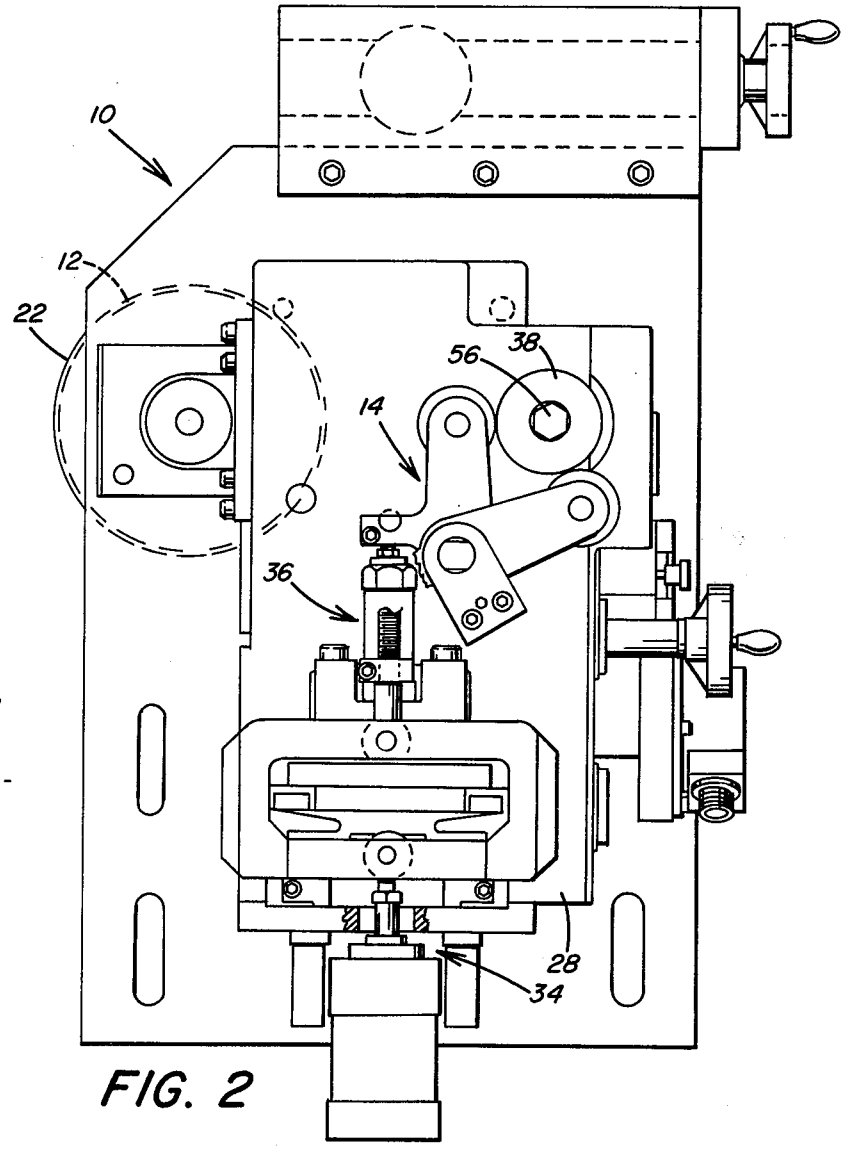
FIG. 2 is an end view of the material feeding device shown in FIG. 1, illustrating a clamp and roll release mechanism associated with the operation of feeding the stock material to the press.
Figure 1:
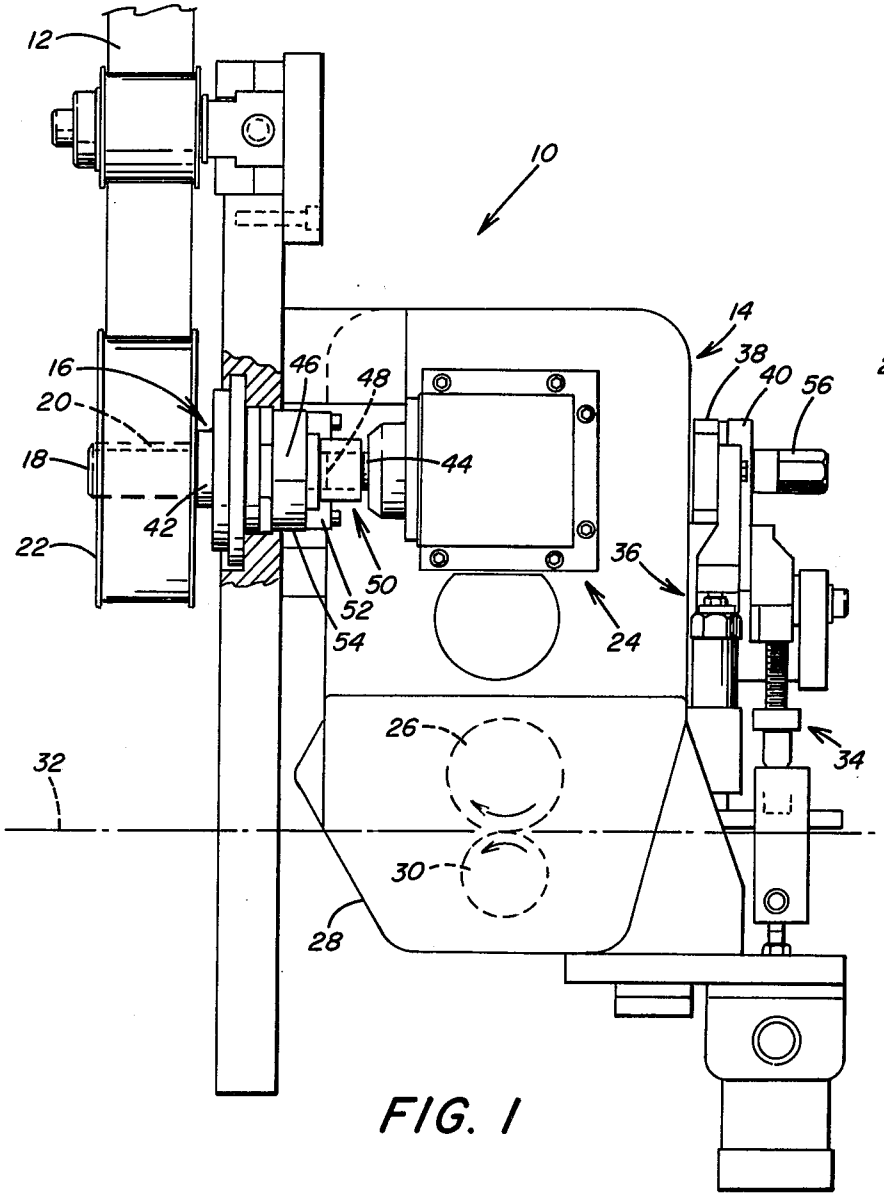
FIG. 1 is a view in side elevation of a device for intermittently feeding preselected lengths of stock material from a coil to a punch press, illustrating a feed roll driven by a feed input shaft drivingly connected to a crankshaft of the press so that the stock material is intermittently fed to the press in timed relation with the press operation.

Referring to FIGS. 1 and 2, there is illustrated apparatus generally designated by the numeral 10 for feeding stock material to a punch press (not shown). As well known in the art and disclosed in U.S. Pat. No. 4,138,913, the punch press has a crankshaft which rotates in timed relation to dies of the press so that there is a timed relationship to the punching operation and the rotational speed of the press crankshaft. A drive pulley is rotated by the crankshaft and one end of an endless belt 12, shown in FIG. 1, is reeved around the crankshaft drive pulley. A feed roll unit 14 is positioned in underlying relation with the press crankshaft and rotatably supports a feed input shaft generally designated by the numeral 16. The input shaft 16 includes an end portion 18 nonrotatably secured by a key 20 to a drive input pulley 22. The drive input pulley 22 is positioned in underlying relation with the drive pulley of the press crankshaft and the second end of the belt 12 is reeved about the pulley 22 to drivingly connect the pulley 22 to the pulley associated with the crankshaft of the press. With this arrangement, continuous rotation of the crankshaft at a predetermined speed is transmitted to the feed input shaft 16.

An adjustable cam drive generally designated by the numeral 24 in FIG. 1 and described in greater detail in U.S. Pat. No. 4,316,569 drivingly connected the input shaft 16 to a driven feed roll 26 that is rotatably supported in a machine frame 28 of the feed roll unit 14. The driven feed roll 26 is positioned in overlying relation with an idler feed roll 30 which is also rotatably supported in the machine frame 28. Stock material is caught between the feed rolls 26 and 30, and the material feed line is generally designated by the numeral 32 in FIG. 1.

The adjustable cam drive 24 converts uniform, continuous rotation of the input shaft 16 to noncontinuous, intermittent rotation of the driven feed roll 26 so that the feed rolls 26 and 30 intermittently advance preselected lengths of the stock material to the punch press in timed relation with the punching operation. Thus, each time the press dies are actuated, another length of the stock material is positioned between the dies. The manner in which the driven feed roll 26 is intermittently driven is beyond the scope of the present invention and is described in greater detail in U.S. Pat. No. 4,316,569.

The continuous rotary motion of the feed input shaft 16 is converted by the adjustable cam drive 24 to generate noncontinuous, intermittent, oscillating rotation of the driven feed roll 26 through a preselected degree of rotation to intermittently feed a preselected length of the stock material or workpiece to the press. The feeding of the workpiece to the press must be in timed relation to the operation of the press so that the press is in a position to receive another length of the workpiece after the press operation has been completed.

Any change in the press operation, such as a change in the material feed line height, die change, or the like, requires a corresponding adjustment in the timed sequence of the feed operation to the press operation. The adjustable cam drive 24 is connected by a linkage to the driven feed roll 26 and generates, for example, rotation of the feed roll 26 from an initial position through a preselected angle, which is adjustable. The cam drive 24 is then operable to stop rotation of the feed roll 26 during a first dwell period of rotation of the cam drive 24 through an angle of 30°. Then the feed roll 26 resumes rotation in the opposite direction through the same preselected angle to its initial starting position. The cam drive 24 returns to its initial starting position at which time the rotation of the feed roll 26 is stopped during a second dwell period of 30° rotation of the cam drive 24.

With this arrangement, for example, the driven feed roll 26 rotates in a clockwise direction corresponding to rotation of the output shaft through a selected angle. During this interval of rotation, a preselected length of stock material is fed to the press by the driven feed roll 26. After completion of the angular movement of the driven feed roll 26, the first dwell period occurs during which time the driven feed roll 26 and the idler feed roll 30 are released from driving engagement with the stock material by a roll release mechanism generally designated by the numeral 34 in FIGS. 1 and 2. A clamping mechanism generally designated by the numeral 36 is actuated to prevent movement of the stock material as the driven feed roll 26 is rotated back to the initial feed position.

After the driven feed roll 26 is rotated counterclockwise through a selected angle of rotation, a second dwell period occurs. During the second dwell period, the clamping mechanism 36 is released from engagement with the stock material. Thereafter, the driven feed roll 26 and the idler feed roll 30 are moved back into driving engagement with the stock material for feeding another increment of stock material to the press.

The clamping mechanism 36 is positioned adjacent to the driven feed roll 26 upstream of the feed roll 26 in the material feed line 32. The clamping mechanism 36 and the roll release 34 are driven by a clamp release cam 38 and a roll release cam 40 respectively. The roll release cam 40 is positioned in front of the clamp release cam 38, as illustrated in FIG. 1. The clamp release cam 38 and the roll release cam 40 have a cam configuration that coordinates with the configuration of the feed cam of the adjustable cam drive 24 so that the feeding of the stock material is synchronized with the engagement of the rolls 26 and 30 with the stock material and release of clamping mechanism from engagement with the stock material.

In operation, upon rotation of the roll release cam 40 with the input shaft 16, the idler feed roll 30 is lowered away from the driven feed roll 26. When the idler feed roll 30 is lowered, the stock material is disengaged from the rolls 26 and 30. During this interval, no material is fed to the press, and the driven feed roll 26 is rotated back to the initial position for the next feed cycle. Prior to the next feed cycle, the idler roll 30 is rotated toward the driven feed roll 26 to return the rolls 26 and 30 to driving engagement with the stock material. Synchronously with the movement of the rolls 26 and 30 from driving engagement with the stock material, rotation of the clamp release cam 38 actuates the clamping mechanism 36 to engage the stock material during the interval of angular rotation of the driven feed roll 26 back to the position for initiating the feed cycle.

In accordance with the present invention, the feed input shaft 16 shown in FIG. 1 includes a first portion 42 and a second portion 44. The shaft first portion 42 includes the end portion 18, which is nonrotatably connected to the drive input pulley 22. The shaft second end portion 44 is drivingly connected to the adjustable cam drive 24. As will be described later in greater detail, the shaft portions 42 and 44 are releasably engageable by an adjustable clamp arrangement. A clamp generally designated by the numeral 50 in FIG. 1 is nonrotatably keyed to the shaft portion 44. The clamp 50 includes an enlarged shoulder 48, which is held in frictional engagement with shaft end 46 by a hub 52. The hub 52 is bolted to an enlarged shoulder portion 54 on shaft end 46 of the input shaft first portion 42. With this arrangement, the hub 52 and the clamp 50 are frictionally engaged to connect the shaft portions 42 and 44 to each other so that the two part feed input shaft 16 operates as a one part, solid shaft to transmit continuous rotation from the timing belt 12 to the feed roll unit 14.

To disconnect the drive connection of the feed roll unit 14 to the belt 12, the bolts on the hub 52 are loosened. The shaft end portions 46 and 48 are then rotatable to permit relative rotation between the shaft first portion 42 and the shaft second portion 44. When the hub 52 and clamp 50 are removed from frictional engagement, the relative position of the feed rolls 26 and 30 is adjusted by rotation of shaft end portion 56 (shown in FIGS. 1 and 2) of the shaft second portion 44. Rotating the shaft end portion 56 rotates the shaft second portion 44 without rotating the shaft first portion 42. This arrangement permits the feed roll unit 14 to be easily disconnected from the press for adjusting the timing between the press operation and the feed operation.

In the prior art feed roll unit, the clamp release cam 38 and the roll release cam 40 were individually timed to one another by loosening each cam on the end of the feed input shaft 16, rotating the cams 38 and 40 to the proper position, and then reclamping the cams 38 and 40 to the end of the input shaft 16. This procedure was required to synchronize the feeding operation with the press operation. Consequently, the machine operator had a number of critical adjustments to make where each adjustment was dependent on the other. This required understanding of the relationship between the various cycles of material feeding, feed roll release, material clamping, and punch operation.

With the present invention, the clamp release cam 38 and the roll release cam 40 are fabricated as a single unit with the surfaces of the two cams 38 and 40 positioned in the required relationship to one another during their initial assembly. This is a single cam arrangement which is secured to the end of the input shaft 16. Thus, the roll release cam and clamp release cam are positioned in the proper relation, and the need to individually adjust the cams 38 and 40 on the input shaft 16 is eliminated. Consequently, there is no need to disturb the relationship of the cams 38 and 40 to each other or their relationship to the feed and press cycles.

Figure 3:
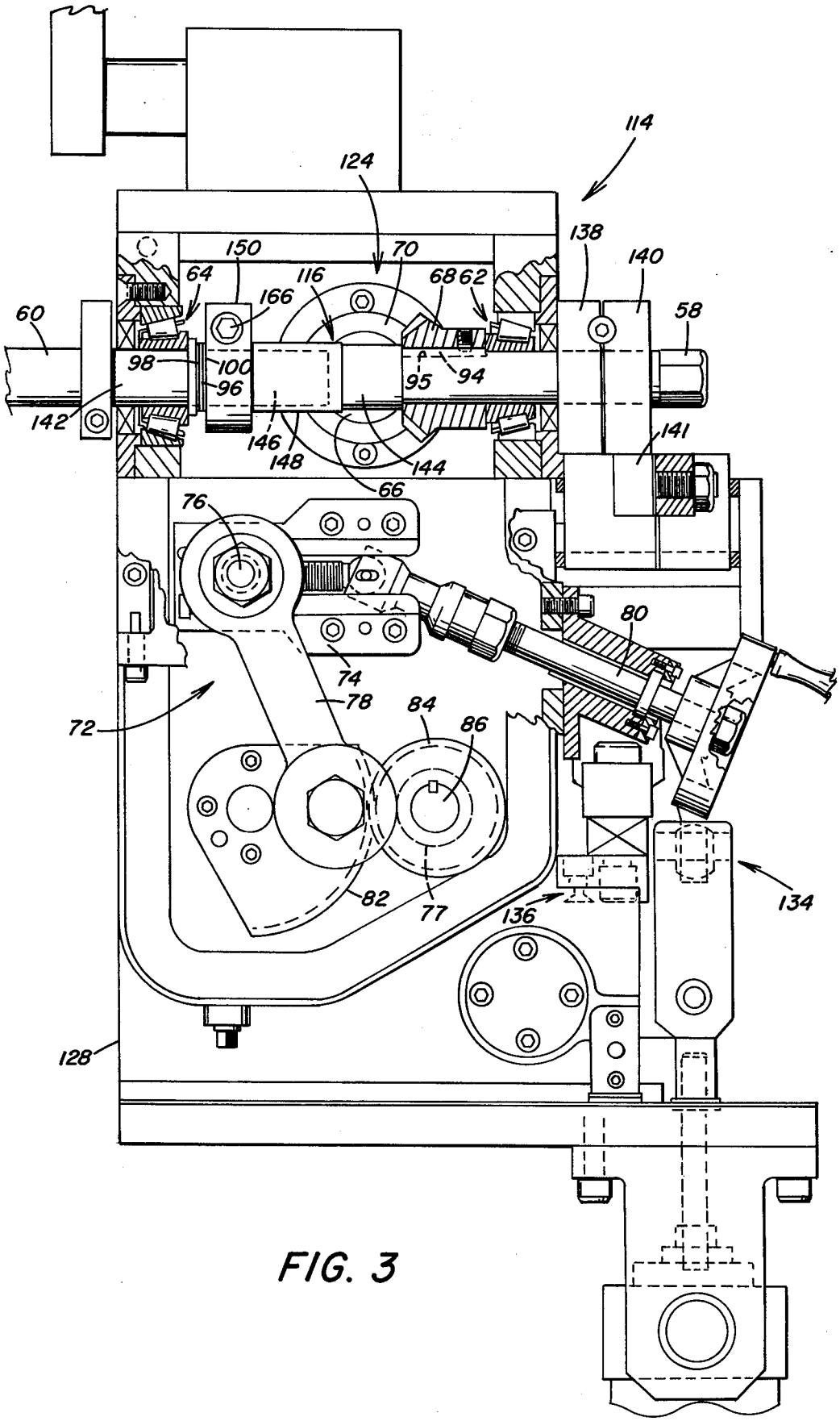
FIG. 3 is another embodiment of a material feeding device illustrating a feed input shaft having interlocked end portions drivingly engageable and disengageable by a clamp surrounding the feed input shaft.

Now referring to FIG. 3, there is illustrated another embodiment of a feed roll unit 114 in which like elements of FIGS. 1 and 2 are designated by numerals increased in magnitude by 100 in FIG. 3. The feed roll unit 114 includes a two part feed input shaft generally designated by the numeral 116 and illustrated in greater detail in FIG. 4. The input shaft 116 has opposite end portions 58 and 60 rotatably supported by conventional bearing assemblies 62 and 64. The shaft end portion 60 is drivingly connected to a drive input pulley (not shown) in a manner similar to that discussed for the input shaft 16 illustrated in FIG. 1. The input shaft end portion 60 is thus continuously rotated at a predetermined speed.

The feed input shaft 116 is drivingly connected to a second powered input shaft 66 by a pair of meshing gears 68 and 70. The second input shaft 66 is also rotatably supported in the machine frame 128. The second input shaft 66 is nonrotatably connected to the adjustable cam drive 124. With this arrangement, the continuous rotation of the second input shaft 66 is converted by the cam drive 124 to oscillating rotation movement of an output shaft (not shown) that is connected to a linkage assembly generally designated by the numeral 72.

The linkage assembly 72 includes a transfer arm 74 that slidably supports a slide block 76 that is connected to one end of a drive link 78. The position of the slide block 76 on the transfer arm 74 is adjustable by means of an adjusting screw 80. Rotation of the adjusting screw 80 in a preselected direction moves the slide block 76 to a preselected position on the transfer arm 74. This adjustment controls the angle of rotation of the feed roll 77 for a preselected feed length of the workpiece to the press. The drive link 78 is connected through a pair of meshing gears 82 and 84 to a shaft 86 of the driven feed roll 77. Thus, the oscillating rotational movement transmitted to the linkage assembly 72 from the cam drive 124 is transmitted to the driven feed roll. Adjustments to the length of travel of the drive link 78 to provide a selected degree of rotation of the driven feed roll corresponding to a preselected feed length is described in greater detail in U.S. Pat. No. 4,316,569 and is beyond the scope of the present invention.

Also shown in FIG. 3 are a clamp release cam 138 and a roll release cam 140. The cams 138 and 140 are prearranged to the required relationship to each other for the material feed cycle and are connected to the end 58 of the feed input shaft 116. The cams 138 and 140 actuate operation of the clamping mechanism 136 and the feed release mechanism 134 respectively, as above described for the arrangement illustrated in FIGS. 1 and 2. The cams 138 and 140 are a single unit and do not require adjustments relative to each other on the shaft end 58.

Figure 4:
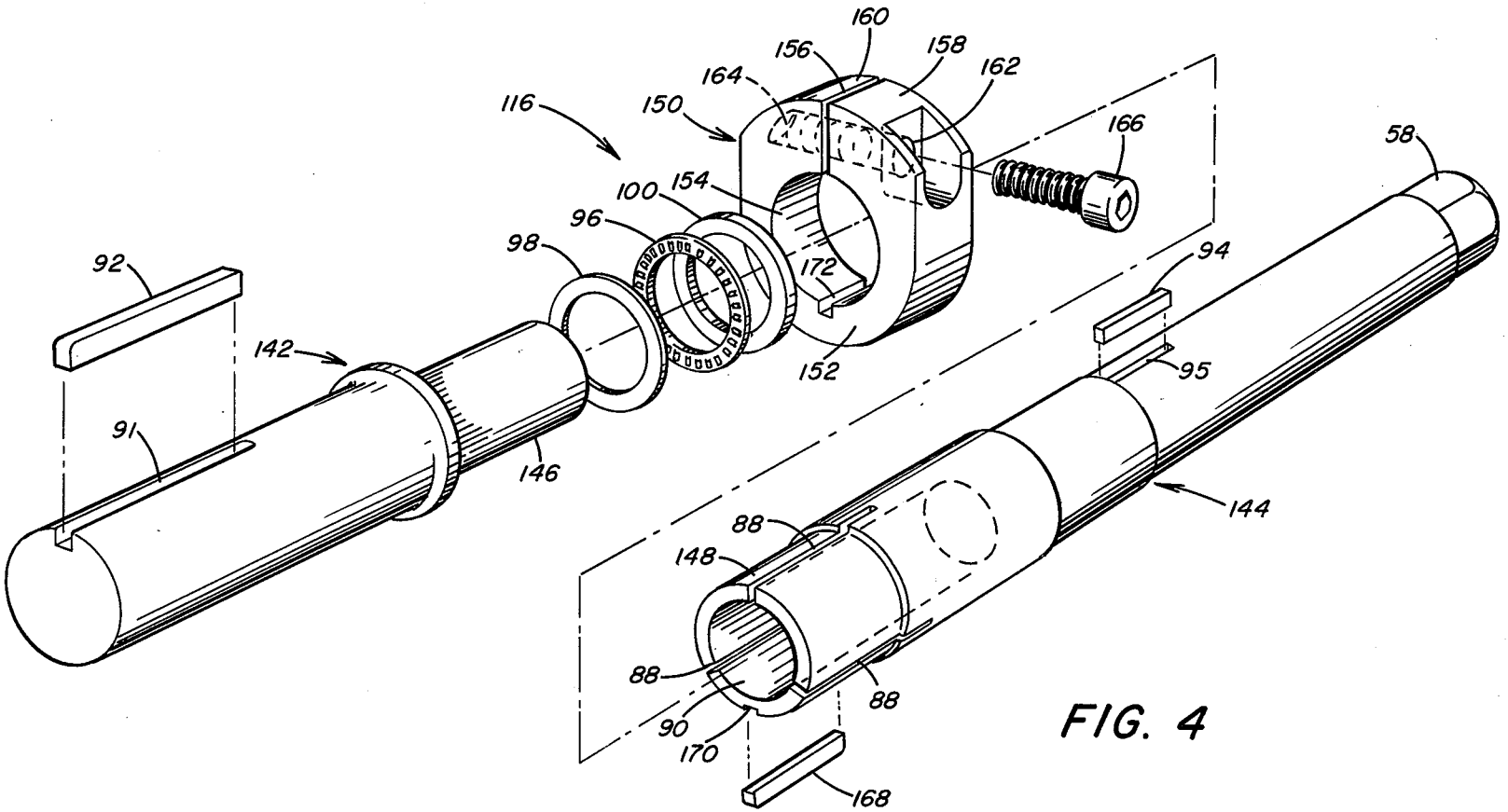
FIG. 4 is an exploded isometric view of the two part feed input shaft and the clamp therefor shown in FIG. 3.

The input shaft 116 for the embodiment illustrated in FIG. 3, is shown in greater detail in FIG. 4. The shaft 116 includes a first portion generally designated by the numeral 142 and is releasably engageable with a second portion generally designated by the numeral 144 where a first portion end portion 146 extends into an adjacent second portion end portion 148. The end portions 146 and 148 are releasably connected by a clamp generally designated by the numeral 150.

In accordance with the present invention, the shaft portion 144 is provided with a split configuration at the end portion 148. This split configuration is formed by a plurality of sawcuts 88 extending from the extreme end portion 148 a preselected axial distance thereon. The sawcuts 88 surround a bore 90 that extends from the end portion 148 a preselected distance into the shaft portion 144. The shaft end portion 146 extends into the bore 90. The feature of the sawcuts 88 permits radial expansion and contraction of the shaft end portion 148 around the shaft end portion 146. The assembled input shaft 116 includes the end portion 60 having a keyway 91 for receiving a key 92 to nonrotatably connect the drive input pulley (not shown) to the shaft end portion 60. Similarly, the gear 68 shown in FIG. 3 is nonrotatably connected to the shaft portion 144 by a key 94 received in a keyway 95.

As illustrated in FIG. 3, the shaft end portion 146 extends into the bore 90 of the shaft end portion 148. Positioned around the end portion 146 is a thrust bearing 96 (shown in detail in FIG. 4) held in position by a pair of thrust washers 98 and 100. The washer 98 abuts against an enlarged shoulder 102 on the shaft portion 142 and the washer 100 abuts against the clamp 150.

The clamp 150, as shown in detail in FIG. 4, has a split body 152 with a bore 154 therethrough. A sawcut 156 extends down through the body portion 152 to the bore 154 forming a pair of movable body portions 158 and 160. The body portion 158 includes a threaded bore 162 aligned with a threaded bore 164 in body portion 160. A clamp screw 166 extends through and is engageable with the threaded bore 164 to draw together the body portions 158 and 160 around the assembled input shaft 116. The clamp body 152 is nonrotatably connected to the shaft split end portion 148 by the mating engagement of a key 168 in a keyway 170 of the shaft end portion 148 and a keyway 172 in the clamp body 152.

With the above described arrangement, during operation of the feed roll unit 114 the clamp screw 166 is securely tightened in the clamp 150 to urge the split end portion 148 into frictional engagement with the shaft end portion 146 and nonrotatably connect the shaft portion 142 to the shaft portion 144 to form the unitary input shaft 116. To disconnect the drive of the feed roll unit 114 to the press, the clamp screw 166 is loosened to the point where the shaft portion 144 is rotatable relative to the shaft portion 142. In this position, the input shaft end portion 58 is rotated to the desired position of the feed cycle without affecting the press cycle and without having to disengage the endless timing belt shown in FIG. 1 from the feed input shaft.

In operation, to time the feed roll unit 114 to to the press with the feed roll unit 114 in the roll feed release position, the punches or pilots of the press are in a position about to enter the stock material. A strip of the stock material is positioned between the driven feed roll and idler feed roll and then the clamping mechanism 136 is actuated to close the rolls on the stock material therebetween. Thereafter, the portions 142 and 144 of the input shaft 116 are disconnected for relative rotation therebetween. The hex end 58 of the input shaft 116 is rotated until the feed release cam follower 141 (shown in FIG. 3) is moved to a preset position which is marked on the roll release cam 140. Once the feed release mechanism 134 is in the desired position, the clamp screw 166 is tightened on the clamp 150 to nonrotatably connect the input shaft portions 142 and 144. Thus, the timing adjustment can be made without having to disconnect the timing belt from the pulley of the feed input shaft 116.

Figure 5:
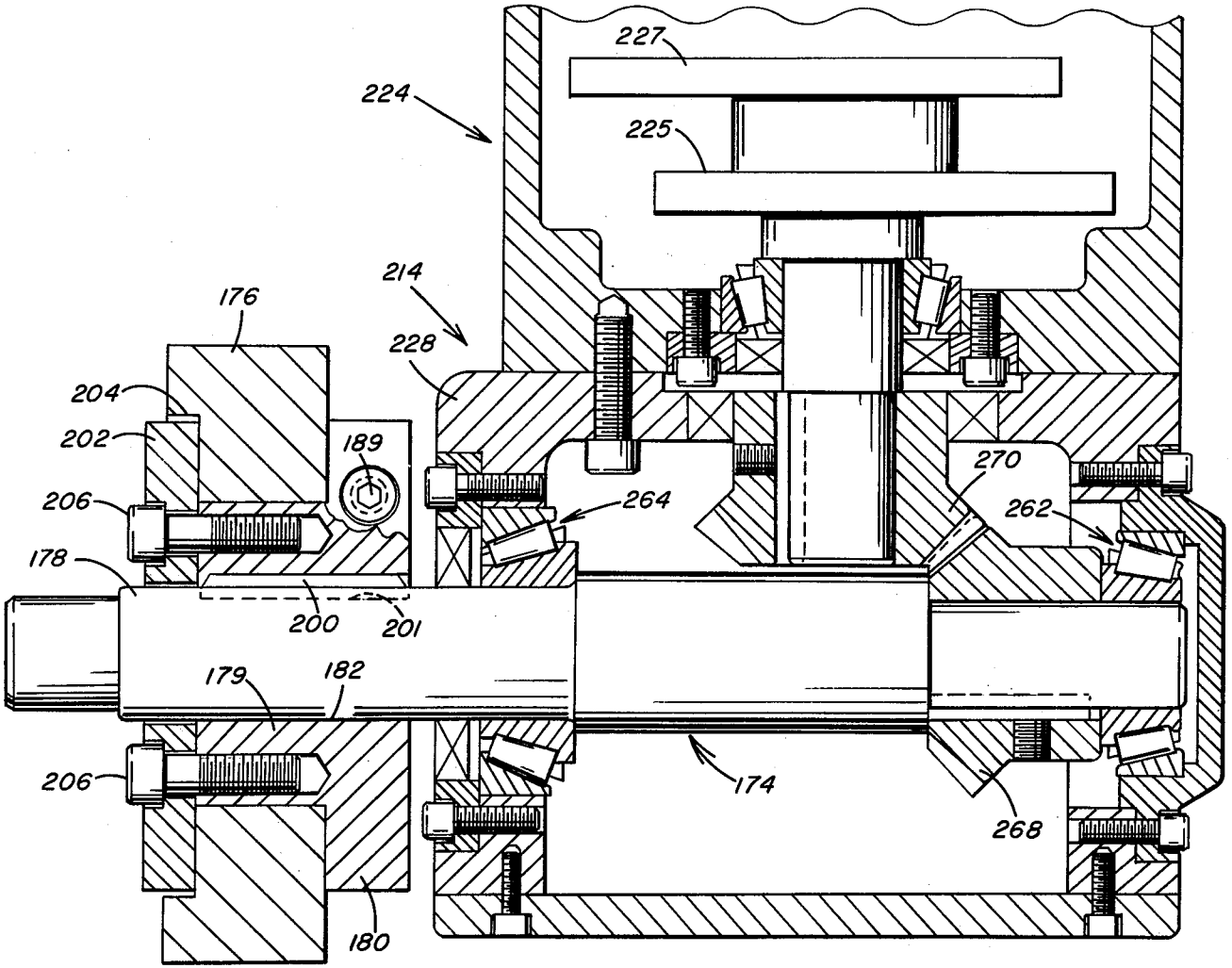
FIG. 5 is a further embodiment of a feed input shaft for transmitting rotation from the press to the material feed device, illustrating an arrangement for adjustably connecting an input shaft pulley to an end of the input shaft to permit adjustments in the timing of the sequence of the operation of the press to the operation of the material feed.

Referring to FIG. 5, there is illustrated a further embodiment for adjustably connecting the drive from the press crankshaft to a feed roll unit 214 by a feed input shaft generally designated by the numeral 174. The elements shown in FIG. 5 corresponding to the elements shown in FIG. 3 are designated by the numerals in FIG. 3 raised to the magnitude 200. The feed input shaft 174 is rotatably supported in the machine frame 228 by a pair of bearing assemblies 262 and 264. Continuous rotation of the feed input shaft 174 is transmitted to the adjustable cam drive 224 that includes a pair of radial conjugate cams 225 and 227. The feed input shaft 174 is provided with an adjustable input pulley 176 releasably connected to end portion 178 of shaft 174 by a pulley clamp bushing 180.

Figure 6:
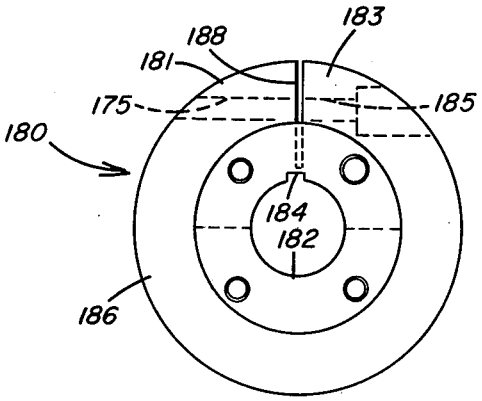
FIG. 6 is an end view of an input shaft drive pulley bushing shown in FIG. 5.
Figure 7:
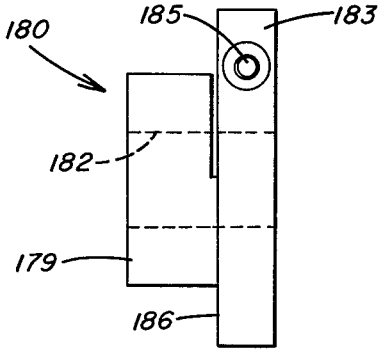
FIG. 7 is an view in side elevation of the input shaft drive pulley bushing shown in FIG. 6.

The clamp bushing 180 is illustrated in greater detail in FIGS. 6 and 7 and includes a hub portion 179 having through bore 182 and a keyway 184. A body 186 of clamp 180 has a slot 188 forming relatively movable body portions 181 and 183 having a threaded bore 175 and a through bore 185 respectively adapted to receive a clamp screw 189 shown in FIG. 5. The shaft end portion 178 includes a keyway 201 adapted to receive a key 200 which is also positioned in the clamp keyway 184. This arrangement nonrotatably connects the clamp bushing 180 to the shaft end portion 178. The hub portion 179 of the clamp bushing 180 is concentric with the bore 182 and the bore of the pulley 176. Thus, tightening the clamp screw 189 axially fixes the hub portion 179 on the shaft end portion 178 for positioning the pulley 176 to receive the pulley belt.

A disc 202, as illustrated in FIG. 5, is positioned in a recess 204 of the pulley 176 and is bolted to the clamp bushing 180 by bolts 206 to clamp the pulley 176 between the disc 202 and the clamp bushing 180. With this arrangement, to disconnect the feed roll unit 214 from the press, the bolts 206 are loosened to release the disc 202 from frictional engagement with the input pulley 176 and the pulley 176 from frictional engagement with the clamp bushing 180. Loosening the bolts 206 permits relative rotational movement between the pulley 176 and the shaft end portion 178 for making the timing adjustments as above described to the feed roll unit 214.

In accordance with the present invention, the adjustable input shaft that transmits the continuous rotation from a suitable drive means, such as from the output of a punch press or from any other source, is positioned between the source of continuous drive and the input drive to the feed roll unit, as above described. In the above discussed arrangement, a timing belt and associated pulley have been described as the source of continuous rotation to the adjustable feed input shaft of the feed roll unit. However, it should be understood that the present invention is not limited to the use of belt drive but other drive means are adaptable, such as a gear train, drive shaft, chain drive and the like.

Figure 8:
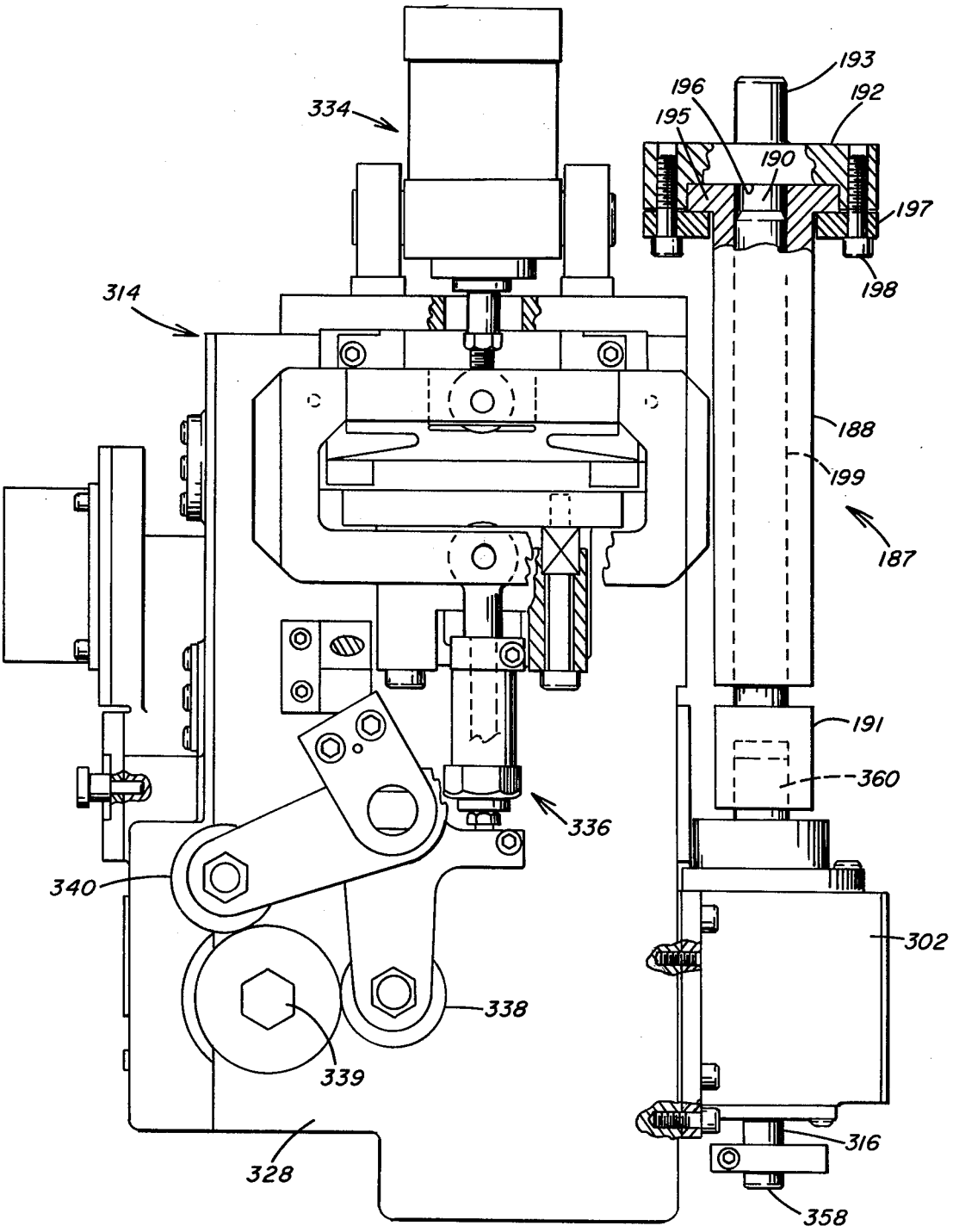
FIG. 8 is a view in side elevation of an additional embodiment of a material feed device, illustrating an adjustable feed input shaft for drivingly connecting the output of a press to the input of the material feed device in a manner permitting efficient adjustments to the sequence of operations performed by the press and the material feed device.

FIG. 8 illustrates an embodiment of the present invention that utilizes a drive shaft arrangement generally designated by the numeral 187 as the source of continuous rotation to the feed input shaft 316 of the feed roll unit 314. It should be understood in FIG. 8 that like elements of FIGS. 1, 2 and 3 are designated by like numerals raised to the magnitude of 300. The feed input shaft 316 is rotatably supported by bearing assemblies in a manner similar to that illustrated in FIG. 3, housed within a case 302 that is bolted to the machine frame 328. The input shaft 316 has a first end portion 360 connected to the drive shaft 187 and a second end portion 358. Continuous rotation of the feed input shaft 316 is transmitted to a second input shaft that is nonrotatably connected to the adjustable cam drive, as above described, of the feed roll unit 314. Continuous rotation of the second input shaft is converted by the cam drive to oscillating rotational movement which is transmitted to the drive feed roll, not shown in FIG. 8. The feed roll unit 314 also includes the feed release mechanism 334 and the clamping mechanism 336, described above.

The drive shaft arrangement 187 includes a drive tube 188 surrounding, in nonrotatable and axially movable relation, a square drive rod 199. The drive rod 199 has an upper end portion 190 and a lower, socket end portion 191. Drive tube upper end portion 195 is drivingly connected to a drive coupling 192 having an adapter 193 that is suitably connected to a source of continuous rotation, such as the crankshaft of a press. The drive rod socket end portion 193 that is nonrotatably connected to the feed input shaft end portion 360. With this arrangement, rotation of drive tube 188 is transmitted to drive rod 199 and therefrom to the feed input shaft end portion 360.

The drive tube upper end portion 195 is received within a recess 196 of the drive coupling 192. A clamp 197 is secured by bolts 198 to the drive coupling 192 to frictionally and thereby drivingly engage drive tube end portion 195 to the drive coupling 192. When the bolts are tightened on the drive coupling 192, the clamp 197 is urged upwardly toward the drive coupling 192 to move the drive tube enlarged upper end portion 195 into frictional engagement with the drive coupling 192. Thus, continuous rotation imparted to the drive coupling 192 is transmitted to the drive rod 199 and therefrom to the feed input shaft end portion 360.

In order to disconnect the drive to the feed input shaft 316 with the embodiment illustrated in FIG. 8, the bolts 198 are loosened on the clamp 197 to remove the drive tube enlarged upper end portion 195 from frictional and driving engagement with the drive coupling 192. The bolts 198 are loosened to the extent to release the drive tube 188 from frictional engagement with the drive coupling 192. This permits the drive tube 188 to move axially on the drive rod 199. Thus, the drive tube 188 is vertically movable between the drive coupling 192 and the drive rod socket end portion 191 to facilitate connection and disconnection of the feed input shaft 316 to the source of continuous rotation. Then the timing adjustments to the feed roll unit 314 in relation to the press operation are made by rotating a roll release cam drive shaft 339.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for intermittently feeding a workpiece to a press comprising, press drive means for generating continuous rotation at a predetermined speed, a machine frame, an input shaft supported for rotation in said machine frame, said input shaft having a first portion and a second portion, clamp means for releasably engaging said input shaft first portion to said input shaft second portion to permit relative rotation between said input shaft first and second portions, said press drive means being drivingly connected to said input shaft first portion to rotate said input shaft at said predetermined speed, feed means supported in said frame for intermittently feeding a preselected length of the workpiece to the press, rotation transmission means supported in said machine frame for drivingly connecting said input shaft second portion to said feed means to convert the continuous rotation of said input shaft to intermittent rotation of said feed means and intermittently feed a preselected length of the workpiece to the press in timed relation with the press operation, and said clamp means being releasable to drivingly disconnect said input shaft first portion from said input shaft second portion to permit relative rotation between said first and second portions and allow adjustments in the timed relation between the feeding of the workpiece to the press and the operation of the press on the workpiece.

2. Apparatus as set forth in claim 1 in which, said input shaft first portion has an end portion, said input shaft second portion having an end portion connected to said input shaft first portion end portion, said input shaft second portion end portion having a bore and a plurality of sawcuts therearound permitting radial expansion and contraction of said input shaft second portion end portion around said bore, said input shaft first portion end portion extending into said bore, said clamp means being nonrotatably connected to said input shaft second portion end portion, and tightening means for urging said clamp means to compress said input shaft second portion end portion into frictional engagement with said input shaft first portion end portion to nonrotatably connect said input shaft first and second end portions.

3. Apparatus as set forth in claim 2 in which, said clamp means includes a pair of body portions movable into and out of frictional engagement with said input shaft second portion end portion.

4. Apparatus as set forth in claim 3 in which, said tightening means includes a clamp screw, said clamp means body portions including aligned bores for receiving in threaded engagement said clamp screw, and said clamp screw being movable in said aligned bores to move said body portions into and out of frictional engagement with said input shaft second end portion to drivingly connect and disconnect said input shaft first and second portions.

5. Apparatus as set forth in claim 1 in which, said clamp means is nonrotatably connected to said input shaft second portion, and said clamp means being movable axially to a limited degree on said input shaft second portion.

6. Apparatus for intermittently feeding a workpiece to a press comprising, press drive means for generating continuous rotation at a predetermined speed, a machine frame, an input shaft supported for rotation in said machine frame, said input shaft having a first end portion and a second end portion, rotation transmission means nonrotatably connected to said press drive means for transmitting continuous rotation from said press drive means to said input shaft, said rotation transmission means including an end portion surrounding said input shaft first end portion, clamp means surrounding in abutting relation said input shaft first end portion and secured in a nonrotatable and a fixed axial position thereon, adjustment means associated with said clamp means for nonrotatably securing said rotation transmission means to said input shaft first end portion, and said adjustment means being operable to move said clamp means into and out of frictional engagement with said rotation transmission means to drivingly connect and disconnect said input shaft first end portion to said rotation transmission means so that continuous rotation from said press drive means is transmitted and interrupted to said input shaft.

7. Apparatus as set forth in claim 6 in which, said rotation transmission means includes an input pulley surrounding in abutting relation said clamp means, said adjustment means including a disc connected to said clamp means and movable into and out of frictional engagement with said input pulley so that when said disc is in frictional engagement with said input pulley, continuous rotation is transmitted from said input pulley to said input shaft first end portion, and said disc being movable on said input shaft first end portion out of frictional engagement with said input pulley to drivingly disengage said input pulley from said input shaft end portion.

8. Apparatus as set forth in claim 7 in which, said clamp means includes a pair of body portions surrounding said input shaft first end portion, said pair of body portions being movably connected to secure said clamp means in a fixed axial position on said input shaft first end portion, and said clamp means being keyed to said input shaft first end portion to nonrotatably connect said clamp means thereto.

9. Apparatus as set forth in claim 6 in which, said rotation transmission means includes a drive tube having a first end portion and a second end portion, said drive tube first end portion abutting said rotation transmission means, said drive tube second end portion nonrotatably connected to said input shaft first end portion, said clamp means being releasably connected to said drive tube first end portion, and said adjustment means being operable to move said clamp means on said drive tube first end portion to nonrotatably connect said drive tube to said rotation transmission means.

10. Apparatus as set forth in claim 9 in which, said drive tube second end portion is positioned for axial movement on said input shaft first end portion to permit said drive tube to be moved into and out of driving connection with said rotation transmission means.

* * * * *